US005257951A

United States Patent [19]

Maeda

[11] Patent Number: 5,257,951

[45] Date of Patent: Nov. 2, 1993

[54] ELECTRICAL CONNECTING DEVICE FOR AUTOMOTIVE VEHICLE

[75] Inventor: Yuji Maeda, Shizuoka, Japan

[73] Assignee: Yazaki Corporation, Tokyo, Japan

[21] Appl. No.: 925,101

[22] Filed: Aug. 6, 1992

[30] Foreign Application Priority Data

Aug. 26, 1991 [JP] Japan ..... 3-67511[U]

[51] Int. Cl.[5] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 2,296,633 | 9/1942 | Falge | 439/748 |
| 3,047,831 | 7/1962 | Majewski | 439/748 |
| 3,311,867 | 3/1967 | Beauchaine | 439/748 |
| 4,804,341 | 2/1989 | Kato et al. | 439/752 |

FOREIGN PATENT DOCUMENTS 60-3877 1/1985 Japan .

*Primary Examiner*—Gary F. Paumen

*Attorney, Agent, or Firm*—Sughrue, Mion, Zinn, Macpeak & Seas

[57] ABSTRACT

An electrical connecting device in the form of a fuse box includes an electrical insulating case having a plurality of terminal accommodating chambers arranged in the side-by-side relationship while their opposite end are kept open. A flexible terminal engagement arm is formed integral with each of the terminal accommodating chambers. A terminal is engaged with the terminal engagement arm when it is inserted into the terminal accommodating chamber with a normal attitude. In addition, a terminal engagement member having engagement rods projected therefrom is inserted through the respective terminal accommodating chambers so as to prevent the terminal from being disconnected therefrom after it is inserted into the terminal accommodating chamber with a normal attitude. Engagement rod insert passages are formed through the opposite side walls of the electrical insulating case so a to allow the engagement rods to extend along the engagement rod insert passages. A terminal insert guide is formed in the vicinity of the engagement rod insert passages on the inner wall located opposite to the terminal engagement art in each terminal accommodating chamber.

1 Claim, 9 Drawing Sheets

ELECTRICAL CONNECTING DEVICE FOR AUTOMOTIVE VEHICLE

BACKGROUND OF THE INVENTION

The present invention relates to an improvement of an electrical connecting device such as a fuse box, a relay box, a junction block or the like for an automotive vehicle usable for the purpose of protecting electrical circuits, controlling signals or branching or connecting electrical circuits.

FIG. 8(A) is a perspective view of a conventional fuse box, particularly illustrating essential components constituting the fuse box in the disassembled state. FIG. 8(B) is a fragmentary perspective view of the conventional fuse box, particularly illustrating the assembled fuse box in the exploded state. As shown in the drawings, the fuse box is composed of an electrical insulating case 1, a terminal engagement member 7, terminals 10 and fuses 12.

The electrical insulating case 1 is designed in the form of a rectangular electrical insulating case composed of an upper wall 1*a*, fore and rear side walls 1*b* and left-hand and right-hand side walls 1*c*, and fore and rear rows of terminal accommodating chambers 3 are arranged in the side-by-side relationship in the longitudinal direction while a partition plate 2 is interposed between the fore and rear rows of terminal accommodating chambers 3. Tab insert holes 4 are formed through the upper wall 1*a* so as to allow a pair of tads (blade terminals) for a fuse 12 to be inserted therethrough. As shown in FIG. 11 and FIG. 12, a flexible terminal engagement arm 5 extending toward the tab insert hole 4 side is disposed on the partition plate 2 side in each terminal accommodating chamber 3, and an engagement projection 5*a* adapted to be engaged with an engagement hole 10*b* on the terminal 10 is formed at the free end of the terminal engagement arm 5. In addition, engagement rod insert passages 6 are formed through the left-hand and right-hand side walls 1*c* on the electrical insulating case 1 so as to allow engagement rods 8 of a terminal engagement member 7 to be inserted through the engagement rod insert passages 6 from one side wall to the other one of the electrical insulating case 1.

The terminal engagement member 7 is designed in the U-shaped contour corresponding to the fore and rear rows of terminal accommodating chambers 3 of the electrical insulating case 1 while a pair of engagement rods 8 are connected to each other via a joint plate 9. A terminal 10 includes a base plate 10*a* of which one serves as an electrical contact portion $10_1$ and of which other end serves as an electrical connecting portion $10_2$ which is integrated with to a cable 11. The electrical contact portion $10_1$ is composed of a base plate portion 10*a* having an engagement hole 10*b* formed therethrough, opposite upright standing side walls 10*b*, an opposing pair of resilient contact pieces 10*d* formed by inward folding while extending from the foremost ends of the side walls 10*c* via curved parts and an opposing pair of folded pieces 10*e* formed by inward folding while extending from both the side walls 10*c*.

With the conventional fuse box shown in FIG. 8, when a terminal 10 is inserted into a terminal accommodating chamber 3 of the electrical insulating case 1 with an inclined attitude as shown in FIG. 9, it is accommodated in the terminal accommodating chamber 3 while its inclined attitude is kept unchanged as represented by an arrow-shaped mark in the drawing. While the terminal 10 is accommodated in the terminal accommodating chamber 3 in that way, there arise malfunctions that it can not correctly be connected to a tab 12*a* of the fuse 12, and moreover, an engagement projection 5*a* of a terminal engagement arm 5 shown in FIG. 11(A) can not be engaged with the engagement hole 10*b* due to the positional offset of the former away from the latter. In addition, when the engagement rod 8 is inserted through the engagement rod insert passage 6 with an inclined attitude due to the wide width of the terminal accommodating chamber 3 as shown in FIG. 10, the foremost end of the engagement rod 8 collides against a partition wall 3*a* of the terminal accommodating chamber 3 or the electrical contact portion $10_1$ of the terminal 10 as represented by an arrow-shaped mark in the drawing, causing in the engagement rods 8 and the electrical contact portions 10*a* to be damaged or injured due to the forcible collision therebetween.

FIG. 11(A) and FIG. 12(B) illustrate a double engaged state where the terminal 10 is inserted into the terminal accommodating chamber 3 with a normal attitude, whereby the engagement projection 5*a* of the terminal engagement arm 5 is engaged with the engagement hole 10*b* of the terminal 10 to establish primary engagement therebetween, and thereafter, the engagement rod 8 is engaged with a shoulder of the electrical contact portion $10_1$ of the terminal 10 to establish secondary engagement therebetween. However, there is a possibility that the terminal 10 is inserted into the terminal accommodating chamber 3 with a reverse attitude as shown in FIG. 11(B). This is because of a necessity for maintaining a slight gap between the side wall 10*c* of the terminal 10 and the partition plate 2 for the purpose of assuring that the terminal 10 is smoothly inserted into the terminal accommodating chamber 3 while each terminal engagement arm 5 is squeezed toward the partition plate 2 by the base plate portion 10*a* of the terminal 10 as illustrated in FIG. 12(A). With this construction, when the terminal 10 is partially inserted into the terminal accommodating chamber 3 or it is inserted into the same with a reverse attitude, it is practically difficult to visually recognize the foregoing malfunction from the outside. Thus, terminal insertion is achieved without any recognition of this malfunction.

In addition, as shown in FIG. 13, since terminal engagement arms 5 are formed independently of the opposite surfaces of the partition plate 2 in the terminal accommodating chambers 3 with the partition plate 2 interposed therebetween, deflecting spaces $v_1$ and $v_2$ should be prepared for the terminal engagement arms 5 in the terminal accommodating chambers 3. Consequently, the volumetric capacity assumed by the terminal accommodating chambers 3 for the terminals 10 is unavoidably enlarged in the presence of the aforementioned gap, whereby a width $W_1$ of the electrical insulating case 1 is enlarged correspondingly.

SUMMARY OF THE INVENTION

The present invention has been made in consideration of the aforementioned problems and a object of the present invention is to provide an electrical connecting device which assures that terminals are reliably engaged with the device without any insertion of the terminals and an engagement rod with an inclined attitude while preventing the electrical contact parts and the engagement rod from being damaged or injured. Another subject of the present invention is to provide an electrical connecting device which assures that an electrical insulating case can be designed constructed in smaller dimensions without any incomplete insertion of the terminals.

To solve the aforementioned subjects, according to a first aspect of the present invention, there is provided an electrical connecting device for an automotive vehicle comprising an electrical insulating case having a plurality of terminal accommodating chambers arranged in the side-by-side relationship, the opposite ends of the terminal accommodating chambers being kept open and each of the terminal accommodating chambers including a flexible terminal engagement arm, terminals each adapted to be engaged with the terminal engagement arm at the position where each terminal is inserted into a terminal accommodating chamber with a normal attitude, and a terminal engagement member including engagement rods adapted to be engaged with terminals so as to prevent the terminals from being disconnected from the terminal accommodating chamber when the terminals are inserted into the terminal accommodating chamber with a normal attitude wherein engagement rod insert passages are formed through the electrical insulating case while extending from one side wall to the opposite side wall, wherein a terminal insert guide rib is formed in the vicinity of the engagement rod insert passages at the central part of an inner wall of each terminal accommodating chamber on the opposite side to the engagement arm.

Further, according to a second aspect of the present invention, there is provided an electrical connecting device for an automotive vehicle comprising an electrical insulating case having plural pairs of terminal accommodating chambers arranged in the side-by-side relationship with a partition plate interposed between each adjacent terminal accommodating chambers, the opposite ends of the terminal accommodating chambers being kept open and each pair of the terminal accommodating chambers including flexible terminal engagement arms, terminals adapted to be engaged with the terminal engagement arms at the positions where the terminals are inserted into a terminal accommodating chamber with a normal attitude, and a terminal engagement member adapted to be engaged with the terminals so as to prevent the terminals from being disconnected from the terminal accommodating chambers when the terminals are inserted into the terminal accommodating chambers with a normal attitude, the terminal engagement member having an opposing pair of engagement rods connected thereto via a joint plate, wherein engagement insert passages are formed corresponding to the engagement rods while extending through the respective terminal accommodating chambers from one side wall to the other side wall of the electrical insulating case, wherein a fore part of the partition plate as seen in the inserting direction of terminals is cut such that the cutout portion of the partition plate is bifurcated to form a pair of flexible terminal engagement arms which extend in each opposing pair of terminal accommodating chambers, an elongated hole is formed on at least one side wall of the electrical insulating case, and a spacer is projected from the joint plate so as to allow the spacer to be inserted through the elongated hole.

According to the first aspect of the present invention, when terminals are inserted into the terminal accommodating chamber with an inclined attitude, this can be corrected by the guide rib, resulting in correct engagement of the terminals with the terminal engagement arms being smoothly achieved. In case that they are inserted with a reverse attitude, they (their electrical contact portions) collide against the terminal insert ribs. Thus, an operator can immediately correct the erroneous insertion of the terminals. Similarly, when the engagement rods of the terminal engagement member are slantwise inserted through the electrical insulating case, this can be corrected by the terminal guide ribs without a malfunction of forcible deformation of the terminals.

According to the second aspect of the present invention, since both the terminal engagement arms for an opposing pair of terminal accommodating chambers are bifurcated from a single partition plate, the space between both the terminal engagement arms serves as a common deflecting space. This makes it possible to reduce the space occupied by the terminal accommodating chambers corresponding to the foregoing common space, resulting in the electrical insulating case being designed and constructed in smaller dimensions. The spacer of the terminal engagement member is inserted through the space between the bifurcated terminal engagement arms so as to prevent the terminal engagement arms from inwardly deflecting away from the engaged state. Thus, the terminals are held so as to allow them to be properly spaced away from each other. When one of the terminals is incorrectly inserted into the corresponding terminal accommodating chamber, this causes normal insertion of the spacer to fail to be achieved. In other words, the aforementioned incorrect insertion of the terminal can be checked.

BRIEF DESCRIPTION OF THE DRAWINGS

FIG. 5 (B) is a fragmentary perspective view of the device shown in FIG. 5 (A);

FIG. 6 (B) is a cross sectional view of the device shown in FIG. 5 (A) when terminals are completely inserted into the terminal accommodating chambers;

FIG. 8 (B) is a fragmentary perspective view of the device shown in FIG. 8(A);

FIG. 11 (B) is a sectional view of the device shown in FIG. 8 when the terminal is inserted into the terminal accommodating chamber with a reverse attitude;

FIG. 12 (B) is a sectional view of the device shown in FIG. 12 (A), particularly illustrating that the terminals are completely inserted into the terminal accommodating chambers;

DETAILED DESCRIPTION OF THE PREFERRED EMBODIMENTS

Figure 1:
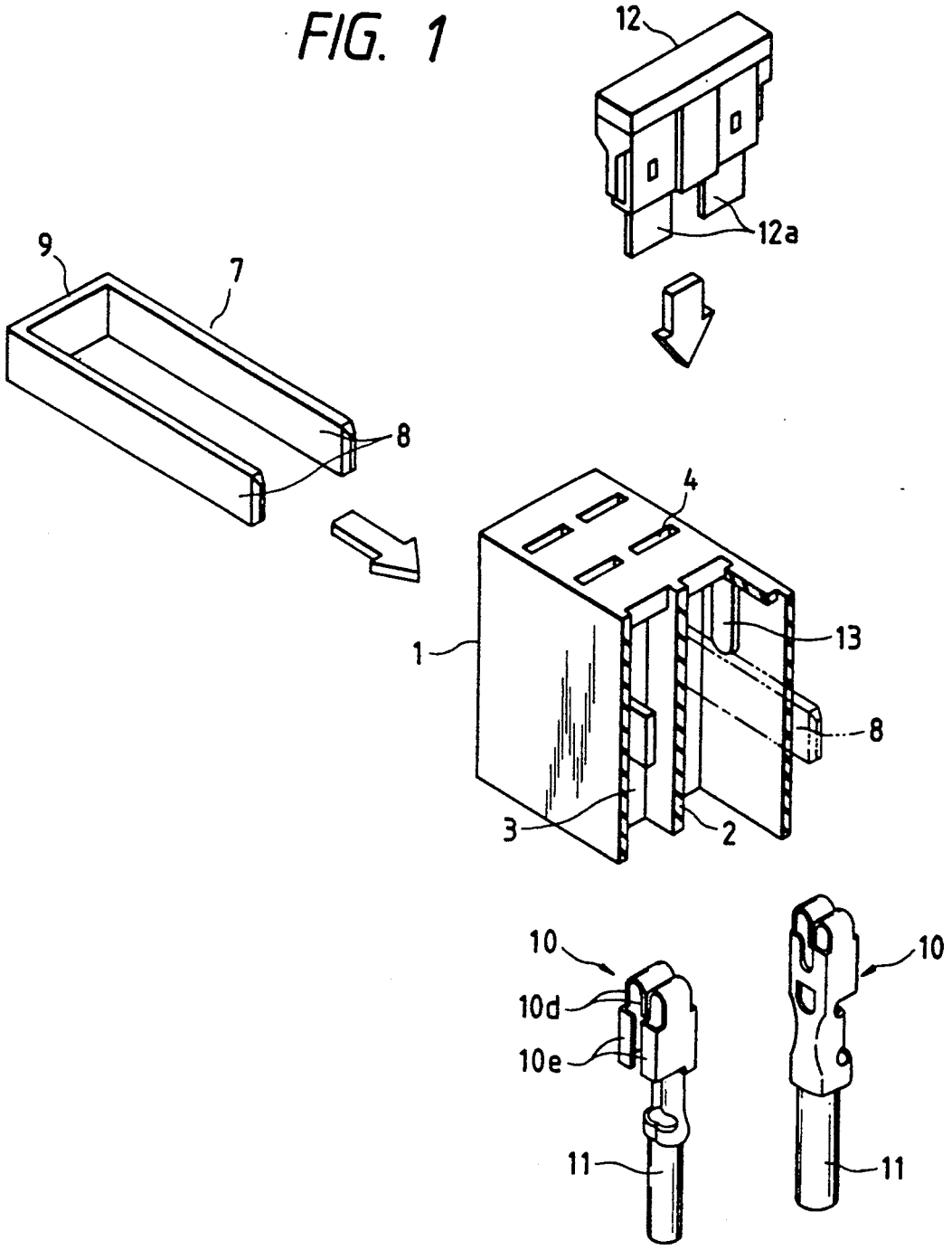
FIG. 1 is an exploded perspective view of an electrical connecting device in the form of a fuse box in accordance with an embodiment of the present invention.

Construction of an electrical connecting device for an automotive vehicle in accordance with the present invention and a mode of operation of the same will be described in detail hereinafter with reference to the accompanying drawings. It should be noted that components similar to those of the conventional electrical connecting device are represented by the same reference numerals and the description is repeated for the purpose of simplification.

FIG. 1 shows by way of a perspective view an electrical connecting device for an automotive vehicle in accordance with a first embodiment of the present invention. The device includes an electrical insulating case 1, and a terminal engagement arm 5 (see FIG. 4) and a terminal insert guide rib 13 formed on an inner wall located opposite to the terminal engagement arm 5 are projected in a terminal accommodating chamber 3 of the electrical insulating case 1. The terminal insert guide rib 13 extends from the tab insert hole 4 side to an engagement rod insert passage 6 (see FIG. 2 and FIG. 3). The foremost end of the insert guide rib 13 is rounded and the insert guide rib 13 is dimensioned to have a width smaller than a gap between a pair of bent pieces 10*e* of a terminal 10.

Figure 2A:
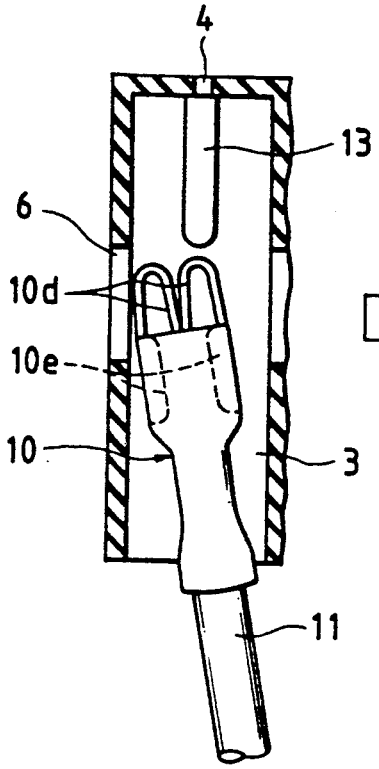
FIG. 2 (A) and 2 (B) are cross sectional views of the device in FIG. 1 when a terminal is inserted into the device with an inclined attitude.
Figure 2B:
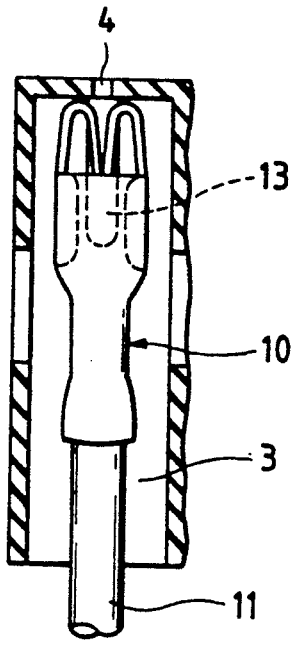
Figure 3A:
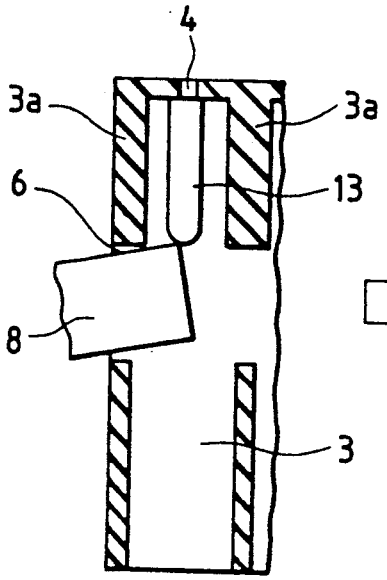
FIG. 3 (A) and 3 (B) are cross sectional views of the device in FIG. 1 when a terminal engagement member is slantwise inserted into the device.
Figure 3B:
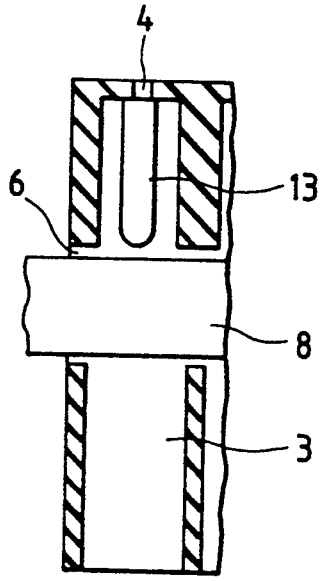

FIG. 2 to FIG. 4 show by way of sectional views a mode of operation of the terminal insert guide rib 13. When the terminal 10 is inserted in the terminal accommodating chamber 3 with an inclined attitude as shown in FIG. 2, it contacts the foremost ends of a pair of resilient contact pieces 10*d*, causing the inclined attitude of the terminal 10 to be corrected as represented by an arrow-shaped mark. Thus, the terminal 10 assumes a normal attitude. Since the terminal insert guide 13 is dimensioned to have a width smaller than a gap between the pair of resilient contact pieces 10*d*, the terminal 10 is permitted to enter the terminal accommodating chamber 3 as it is.

When engagement rods 8 of a terminal engagement member 7 are slantwise inserted through an engagement rod insert passage 6 as shown in FIG. 3, the foremost ends of the engagement rods 8 collide against the foremost end of the terminal insert guide rib 13, causing the inclined attitude of the engagement rods 8 to be corrected as illustrated by an arrow-shaped mark. As a result, the electrical connecting device prevents the terminal 10 and others from being forcibly deformed with an excessive intensity of force. Thus, there is no possibility that the electrical connecting device is injured or damaged.

Figure 4A:
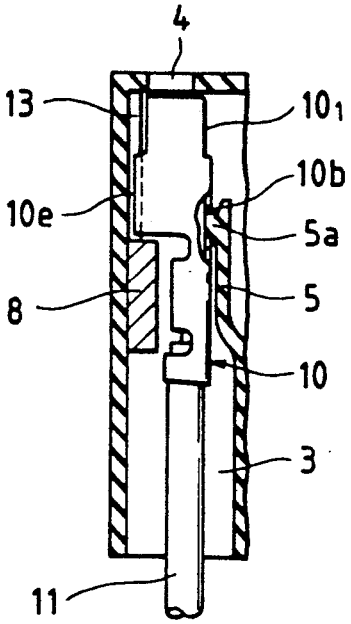
FIG. 4 (A) is a sectional view of the device shown in FIG. 1 when a terminal is inserted into a terminal accommodating chamber with a normal attitude.
FIG. 4(B) is a sectional view of the device shown in FIG. 1 when terminal is inserted into the terminal accommodating chamber with a reverse attitude.
Figure 4B:
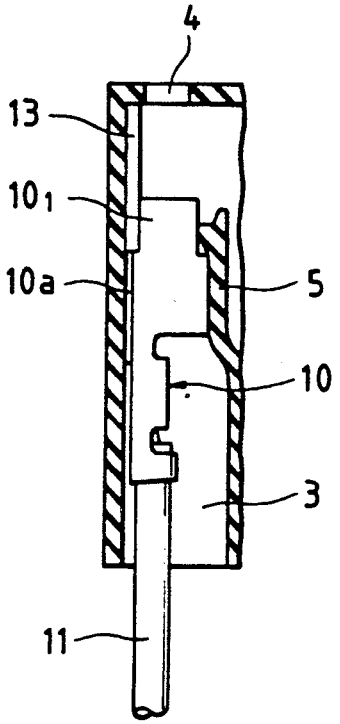

FIG. 4(A) shows by way of a sectional view the state that the terminal 10 is normally inserted into the terminal accommodating chamber 3 with a normal attitude. On the contrary, when the terminal 10 is inserted with the reverse attitude as shown in FIG. 4(B), the foremost end of a base plate portion 10*a* of the terminal 10 contacts the guide rib 13 which inhibits the terminal 10 from being inserted further. Thus, there is possibility that the terminal 10 is erroneously inserted into the terminal accommodating chamber 3 with the reverse attitude.

Figure 5A:
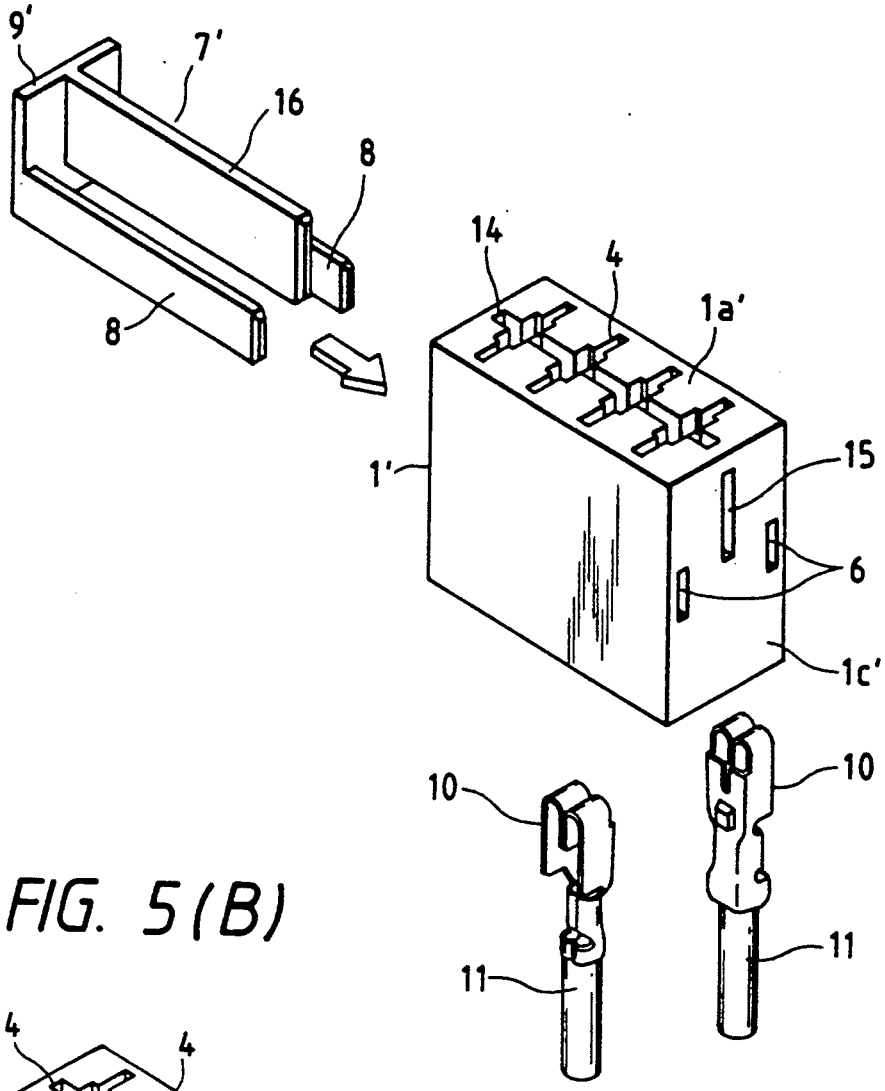
FIG. 5 (A) is an exploded perspective view of another electrical connecting device in the form of a fuse box in accordance with another embodiment of the present invention.
Figure 5B:
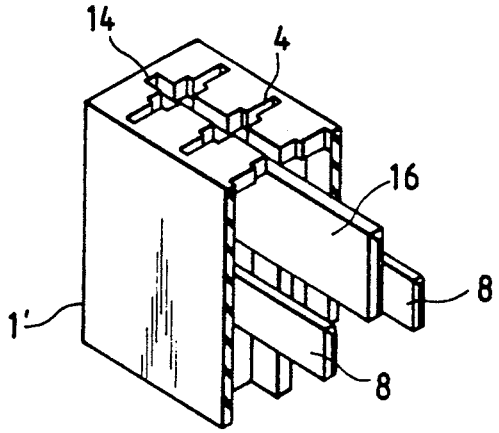
Figure 6A:
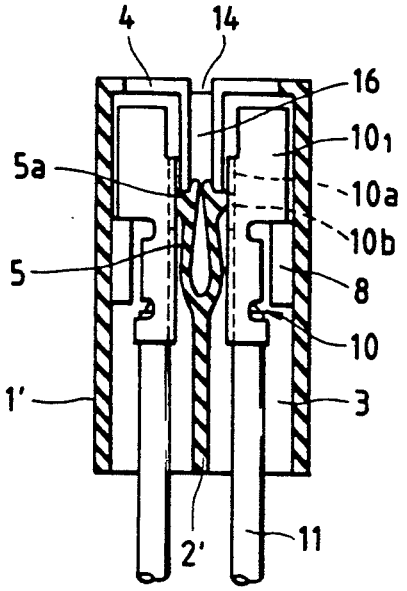
FIG. 6 (A) is a cross sectional view of the device shown in FIG. 5 (A) in the intermediate state of insertion of terminals into terminal accommodating chambers.

FIG. 5 and FIG. 6 show by way of perspective views and sectional views an electrical connecting device for an automotive vehicle in accordance with a second embodiment of the present invention. The device includes an electrical insulating case 1′ in which fore and rear rows of terminal accommodating chambers 3 are arranged in the side-by-side relationship with a partition plate 2′ interposed between each adjacent terminal accommodating chambers 3. As is best seen in FIG. 6, a cutout is formed above the partition plate 2′, and the upper end part of the partition plate 2′ is bifurcated to form a pair of flexible terminal engagement arms 5 corresponding to the pair of terminal accommodating chambers 3. A slit 14 is formed on an upper wall 1*a*′ of the electrical insulating case 1′ corresponding to the partition plate 2′, and engagement rod insert passages 6 and elongated holes 15 are formed through opposite side walls 1*c*′. In addition to engagement rods 8, a spacer 16 is projected forward of a joint plate 9′ of a terminal engagement member 7′ so that it is inserted through the elongated holes 15.

Figure 6B:
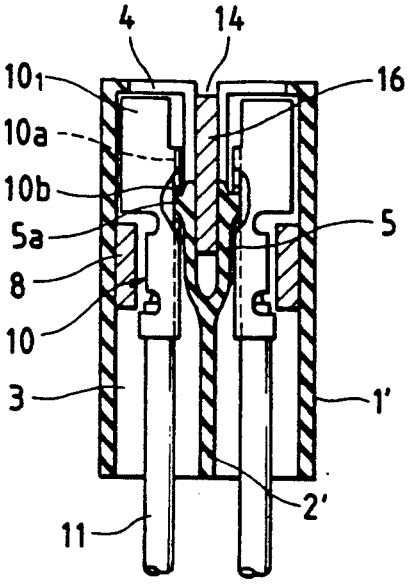
Figure 7:
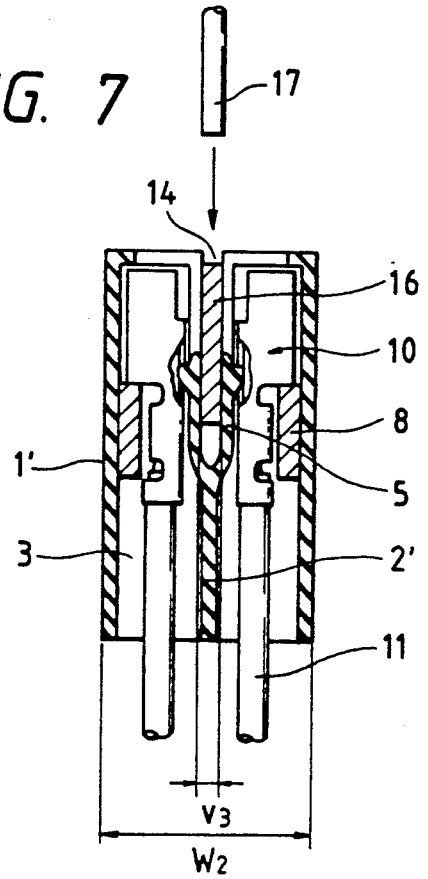
FIG. 7 is a sectional view of the device shown in FIG. 5 detecting whether the terminals are completely inserted into the terminal accommodating chambers or not.
Figure 8A:
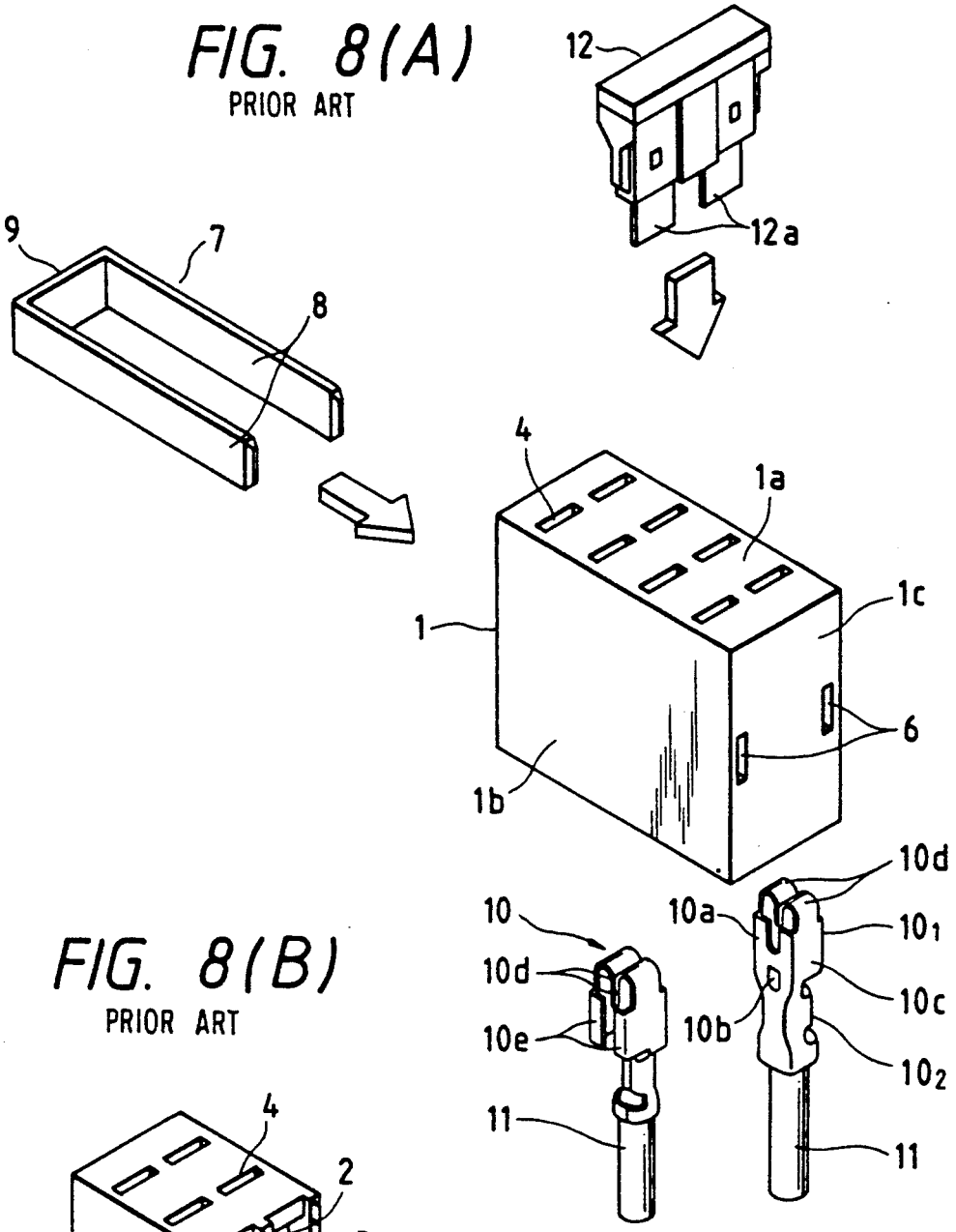
FIG. 8(A) PRIOR ART
FIG. 8 (A) is an exploded perspective view of a conventional electrical connecting device in the form of a fuse box.
Figure 8B:
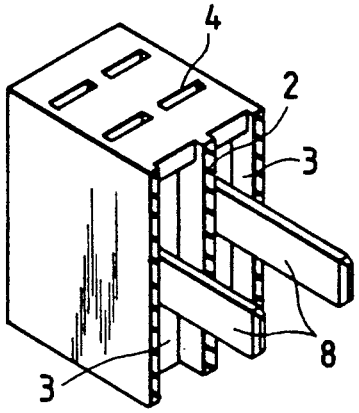
FIG. 8(B) PRIOR ART
Figure 9A:
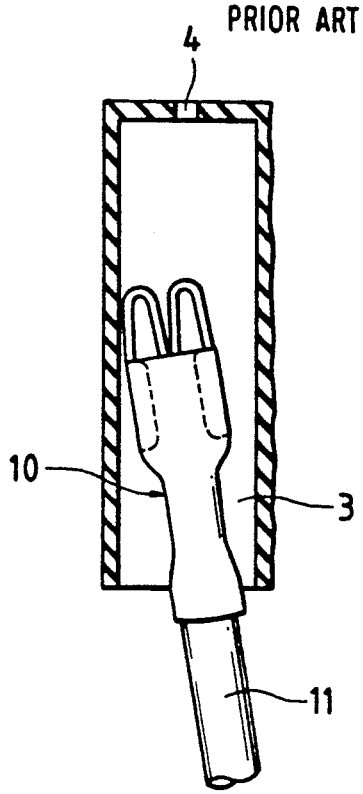
FIG. 9(A) PRIOR ART
FIG. 9 (A) and 9 (B) are cross sectional views of a mode of operation of the device shown in FIG. 8 when a terminal is inserted into a terminal accommodating chamber with an inclined attitude.
Figure 9B:
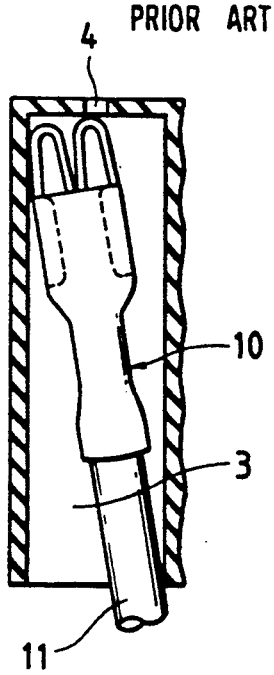
FIG. 9(B) PRIOR ART
Figure 10A:
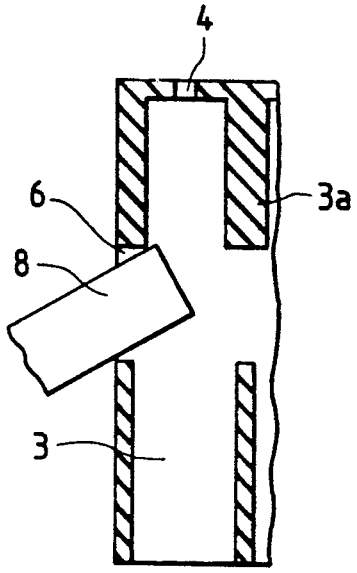
FIG. 10(A) PRIOR ART
FIG. 10 (A) and 10 (B) are cross sectional views a mode of operation of the device shown in FIG. 8 when a terminal engagement rod is slantwise inserted into the terminal accommodating chamber.
Figure 10B:
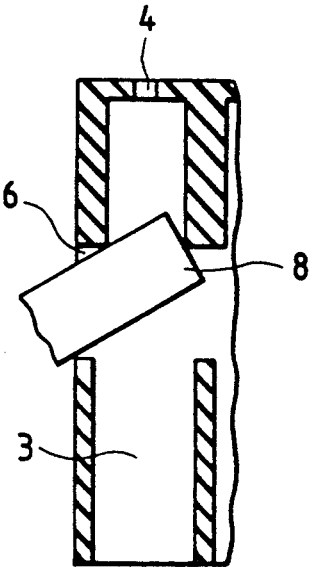
FIG. 10(B) PRIOR ART
Figure 11A:
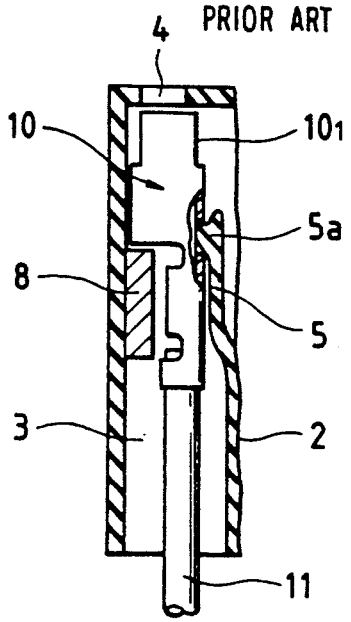
FIG. 11(A) PRIOR ART
FIG. 11 (A) is a sectional view of the device shown in FIG. 8 when a terminal is inserted into a terminal accommodating chamber with a normal attitude.
Figure 11B:
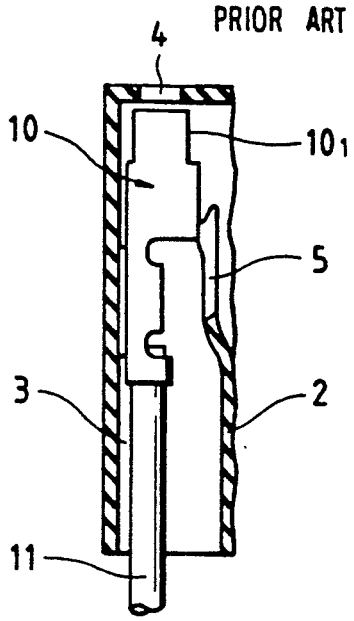
FIG. 11(B) PRIOR ART
Figure 12A:
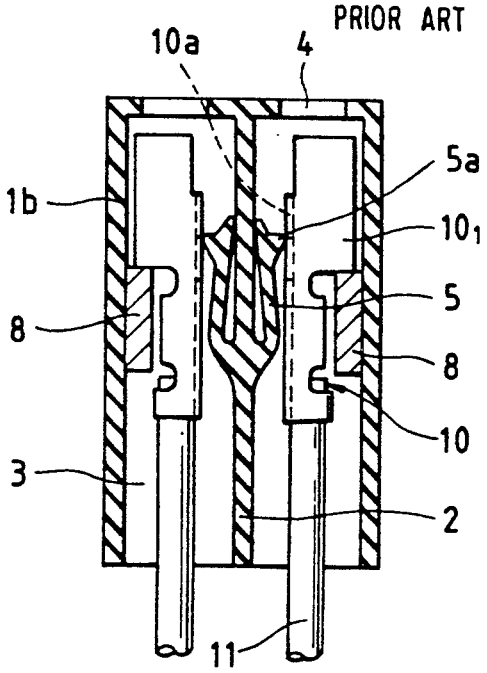
FIG. 12(A) PRIOR ART
FIG. 12 (A) is a sectional view of another conventional electrical connecting device in the form of a fuse box in the intermediate state of insertion of terminals into terminal accommodating chambers.
Figure 12B:
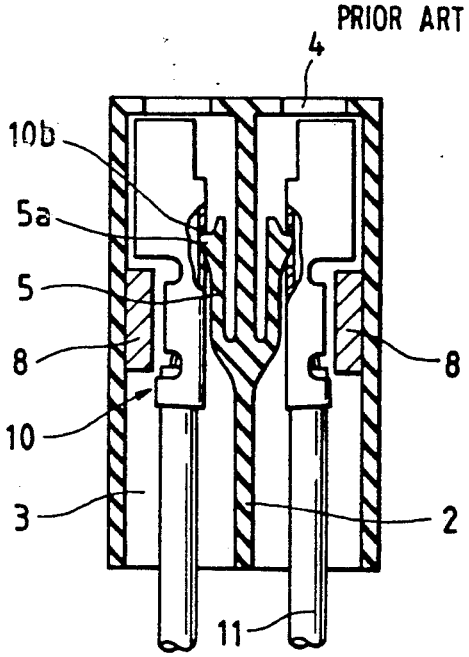
FIG. 12(B) PRIOR ART

In this second embodiment, the gap between the pair of bifurcated terminal engagement arms 5 serves as a deflecting space $v_3$ for allowing them to deflect therein (see FIG. 7). Thus, if one terminal 10 (e.g., right-hand terminal as seen in the drawing) is held in the half inserted state, the terminal engagement arm 5 is caused to resiliently deflect on the deflecting space side, resulting in a sufficient deflecting space failing to be reversed for the other terminal 10 (left-hand terminal as seen in the drawing). Consequently, the other terminal 10 can not completely be inserted into the terminal accommodating chamber 3. In this case, the pair of terminal engagement arms 5 approach each other and thus the deflecting space is greatly reduced. Thus the spacer 16 can not be pierced through the deflecting space, and the terminal engagement member 7′ can not be secured to the device. In this matter, the pair of bifurcated terminal engagement arms 5 prevent the terminals 10 from being incompletely inserted into the terminal accommodating chambers 3. FIG. 6(B) shows by way of a sectional view that the terminals 10 are completely inserted into and engaged with the terminal engagement chambers 3 while the spacer 16 is inserted into the space between the pair of terminal engagement arms 5 without undesirable inward deflection of the terminal engagement arms 5.

Figure 13:
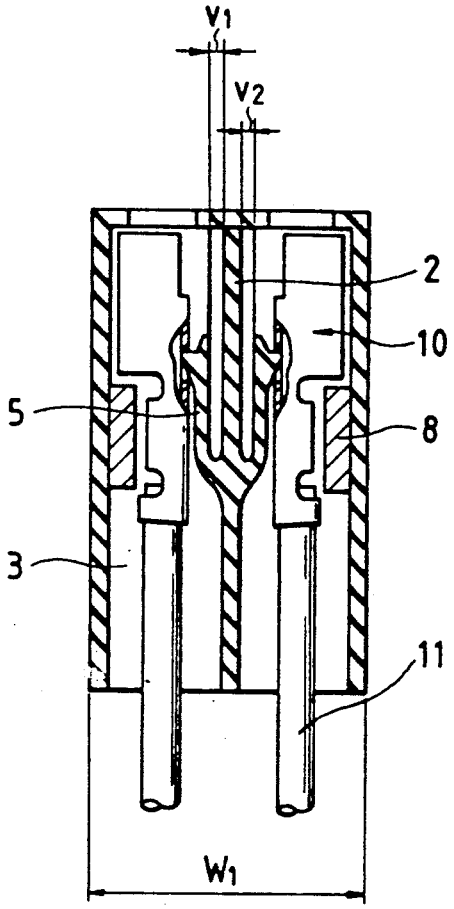
FIG. 13 PRIOR ART
FIG. 13 is a sectional view of the device similar to FIG. 12(B) when the terminals are completely inserted into the terminal accommodating chambers.

Referring to FIG. 7, the pair of terminal engagement arms 5 defines a common deflecting space $v_3$ which is substantially equal to each of the deflecting spaces $v_1$ and $v_2$ of the conventional electrical connecting device which has been described above with reference to FIG. 13. With this construction, it is obvious that a width $W_2$ of the electrical insulating case 1' is dimensioned to be smaller than a width $W_1$ of the electrical insulating case 1 of the conventional device. Thus, the device of the present invention can be designed and constructed in smaller dimensions. In addition, with the device of the present invention, whether or not the spacer 16 of the terminal engagement member 7' is reliably inserted through the space between the terminal engagement arms 5 while the terminals 10 are completely inserted into and engaged with the terminal accommodating chambers 3 can be confirmed by inserting a spacer detecting jig 17 through the slit 14.

The present invention has been described above with respect to the case that the electrical insulating case 1 or 1' is designed in the form of an independent fuse box case. Alternatively, the electrical insulating case 1 or 1' may be designed in an integral structure integrated with a relay box or a junction block case or it may be designed in a cassette type such that it is removably secured to the relay box or the junction block case.

As is apparent from the above description, according to the present invention, since a terminal insert guide rib is formed in a terminal accommodating chamber of an electrical insulating case, a terminal can reliably be engaged with the terminal accommodating chamber without any insertion of the terminal and the engagement rod with an inclined attitude while preventing the electrical contact portion and the engagement rod from being injured or damaged. In addition, a pair of terminals are inserted into the electrical insulating case with a partition plate interposed therebetween, and the partition plate includes a pair of bifurcated flexible terminal engagement arms which define a common deflecting space so as to allow an engagement rod to be inserted through the deflecting space. Thus, there is no possibility that the terminals are incompletely inserted into the terminal accommodating chamber. Additionally, the electrical insulating case can be constructed in smaller dimensions.

What is claimed is:

1. An electrical connecting device comprising:

an electrical insulating case having a plurality of terminal accommodating chambers arranged in parallel to each other in layers, each of said terminal accommodating chambers including a flexible terminal engagement arm;

a terminal engagement member comprising an engagement rod connected to a joint plate, said engagement rod being inserted through an engagement rod insert passage and engaged with each of said terminals in a full engagement position to prevent said terminal being disconnected from said terminal accommodating chamber; and a terminal insert guide rib formed at a central portion of an inner wall of each accommodating chamber in a vicinity of said engagement rod insert passage and said terminal insert guide rib being opposite to said terminal engagement arm, said terminal insert guide ribs acting to maintain said terminal engagement member in a proper orientation as it is inserted through said insert passage;

wherein each of said terminal accommodating chambers has an opening to allow insertion of said terminal, the engagement rod insert passages being formed through said electrical insulating case.

* * * * *